United States Patent [19]

Ahern

[11] Patent Number: 4,559,064

[45] Date of Patent: Dec. 17, 1985

[54] ELECTROSTATIC PRECIPITATOR HAVING SPACERS

[76] Inventor: Anthony J. Ahern, 717 Lucille Ave., SW., North Canton, Ohio 44720

[21] Appl. No.: 609,330

[22] Filed: May 11, 1984

[51] Int. Cl.[4] ..... B03C 3/08; B03C 3/86

[52] U.S. Cl. ..... 55/145; 49/404; 52/652; 52/687

[58] Field of Search ..... 55/140, 143, 145; 52/652, 677, 687; 49/404

[56] References Cited

U.S. PATENT DOCUMENTS

| | | | |
|---|---|---|---|
| 2,822,057 | 2/1958 | Richardson . | |
| 3,018,844 | 1/1962 | Gonzalez . | |
| 3,040,498 | 6/1962 | Berly | 55/143 |
| 3,530,634 | 9/1970 | Adams | 52/687 |
| 4,007,023 | 2/1977 | Batza et al. . | |
| 4,239,514 | 12/1980 | Junkers . | |
| 4,478,614 | 10/1984 | Jonelis | 55/145 |
| 4,479,813 | 10/1984 | Jonelis | 55/145 |

FOREIGN PATENT DOCUMENTS

| | | | |
|---|---|---|---|
| 524896 | 9/1976 | U.S.S.R. | 52/677 |

*Primary Examiner*—David L. Lacey
*Attorney, Agent, or Firm*—Michael Sand Co., L.P.A.

[57] ABSTRACT

A spacer formed of a relatively rigid frame is slidably adjustably mounted on and extends between a pair of horizontally spaced vertically extending ribs of electrostatic precipitator plates to maintain the plates in a predetermined horizontal spaced relationship. The frame preferably is formed by one or two rectangular-shaped frame members having U-shaped hooks attached thereto. The hooks are either attached directly to the plate ribs to frictionally slidably mount the frame between the spaced plates, or connect the two plates together with the plate ribs being clamped therebetween. The frame members and U-shaped hooks preferably are formed of round metal bars. The frame members are mounted on the ribs either at the top or bottom of the precipitator plates and then slidably moved along the ribs until positioned at the desired vertical location. The sliding clamping pressure of the frame members or hooks against the ribs enable the frame to be positioned between the plates without dismantling the plate supports and without a workman entering between the plates to attach the frame in the desired position.

18 Claims, 14 Drawing Figures

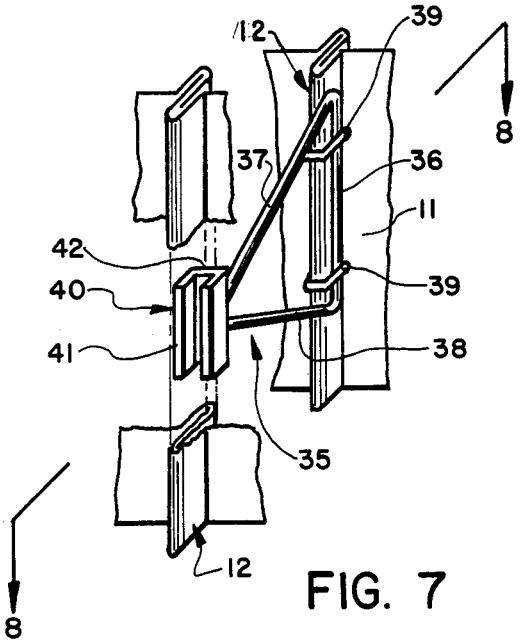
FIG. 7
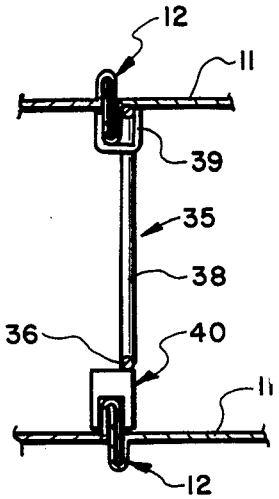
FIG. 8
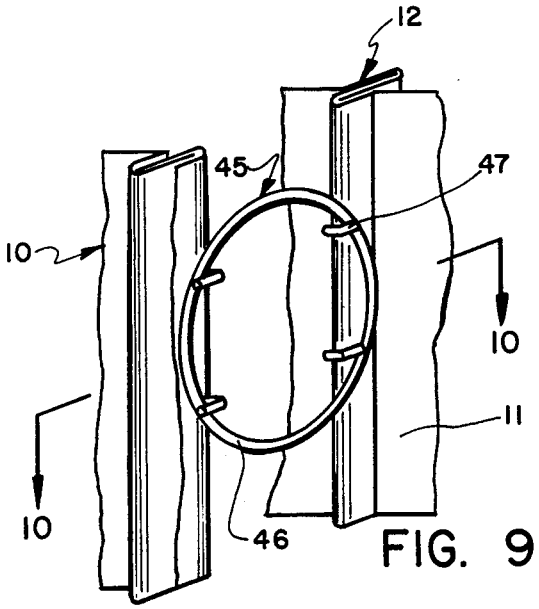
FIG. 9
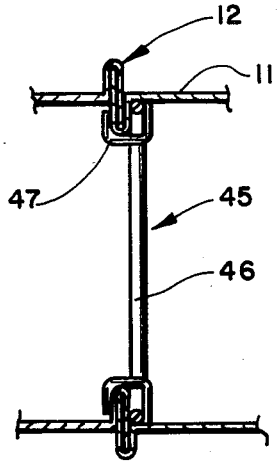
FIG. 10
FIG. 11
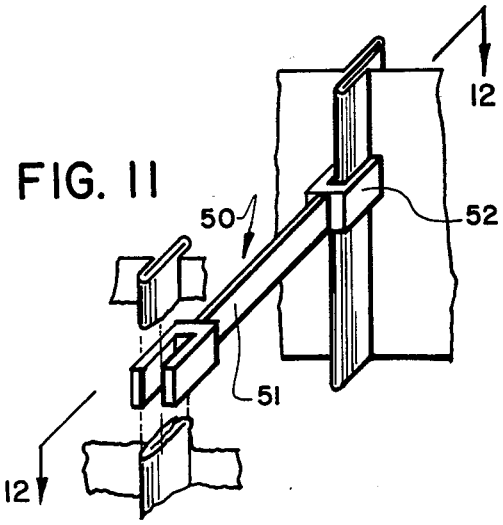
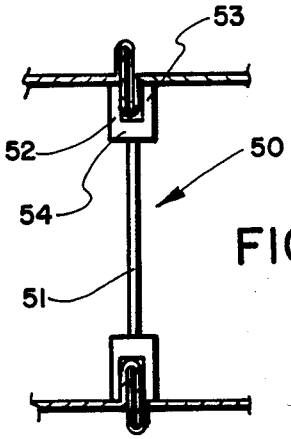
FIG. 12

ELECTROSTATIC PRECIPITATOR HAVING SPACERS

TECHNICAL FIELD

The invention relates to dust collecting electrostatic precipitators and in particular to a spacer for maintaining proper spacing between the collector electrode plates within the precipitator. More particularly, the invention relates to such a plate spacer which can be installed from either the top or bottom of the precipitator plates and moved to the desired vertical position without dismantling the plate supports or requiring permanent attachment between the spacer and plates within the precipitator.

BACKGROUND ART

In the generation of electrical energy by burning coal to produce steam for the generators, a certain amount of waste material in the form of dust and dirt particles, fly ash, etc., is produced during combustion. Heretofore, these waste products were discharged through the smokestacks of the power plants and into the surrounding atmosphere. However, Environmental Protection Agency regulations now require that a large amount of such waste particles be collected before the fumes of combustion are discharged into the atmosphere. One type of apparatus for collecting such particles before they leave the stacks is an electrostatic precipitator (ESP).

These precipitators have been constructed in various forms and configurations. One of the usual types of precipitators consists of a plurality of collector electrode plates and corona electrode wires. The collector plates consist of a series of joined metal plates which are suspended from an upper support and located at a predetermined horizontal spaced relationship with respect to each other. A plurality of the electrode wires are located between the spaced plates and extend vertically therealong. These corona electrode wires, in combination with the collector electrode plates, impart a charge on the dust particles as they move through the spaces between the plates. The particles are charged at a different polarity than the electrode plate, whereby the dust particles are attracted to and collected on the electrode plates for subsequent removal from the bottom of the precipitator. The electrode plates are mounted on an upper supporting structure and are joined by a variety of construction methods.

One form of plate construction consists of a plurality of individual plates or panels, the edges of which are bent into flanges which are interlocked with the adjacent flange of the adjacent panel. These interlocking flanges form outwardly projecting ribs which extend vertically along the length of the collector plates. In addition to joining the individual electrode plates, the ribs provide strength to the assembled plates enabling the plates to maintain a flat parallel relationship with respect to the horizontally spaced adjacent plate.

It is critical that the plates maintain a constant predetermined horizontal spacing from each other, and in particular a constant spacing from the corona electrode wires extending between the spaced plates. This spacing is critical due to the high voltage which is applied to the plates and wires to prevent arcing therebetween and the subsequent destruction of the electrostatic field produced for collecting of the dust particles.

It is desirable that as high a voltage as possible be impressed on the plates and wires to more efficiently collect the particles passing between the plates. However, if this spacing is not maintained, the voltage must be reduced to prevent arcing, thereby reducing the efficiency of the precipitator.

Precipitators having the particular plate connection and supporting arrangements described above, as well as other plate arrangements, sometime experience a serious problem of plate warping. Plate warping can occur during the life of the precipitator for various known and unknown reasons and seriously affects the spacing between the plates and electrode wire. This warping increases the danger of arcing between the wire and adjacent plate requiring the lowering of the applied voltage and consequently lowering of the efficiency of the precipitator.

In order to maintain the plates in vertical alignment to eliminate or reduce plate warpage, various methods and spacers have been developed. One method involves placing kinks in the warped plate ribs. This solves the problem but only for short periods of time. The most satisfactory means is the use of various spacer bars or cross braces which are attached to the plate, usually by welding. These braces extend horizontally between the plates and provide sufficient strength and rigidity to maintain the plates in their spaced parallel relationship. However, the installation of such spacer bars is extremely expensive and time consuming. A workman must enter between the spaced plates to mechanically attach the spacer to the plates. This attachment can only be done after much of the supporting hardware for the plates and corona wires are removed. This increases considerably the "downtime" of the precipitator as well as increased labor cost. Various types of plate straighteners or cross braces are shown in U.S. Pat. Nos. 2,822,057; 3,018,844; 3,028,715; 3,114,616; 3,418,792; 3,678,653; 3,836,135; 4,007,023; 4,239,514; and 4,240,810.

Although many of plate spacers of these patents perform satisfactory, they are expensive to install since it requires partial dismantling of the electrode plates and wire supporting system so that a workman can enter the spaces between the plates for installing the same. Likewise, many of these plate straighteners are intended for new installation only and are not practical for installation in existing precipitators should the plate warpage occur after the precipitator has been in service for some time.

Accordingly, the need has existed for an improved plate spacer for electrostatic precipitators which can be installed at various vertical positions along the length of the collector electrode plates without requiring dismantling of the supports of the collector electrodes or corona electrode wires and which is relatively inexpensive, yet highly effective in maintaining the plates in a predetermined spaced relationship.

DISCLOSURE OF THE INVENTION

Objectives of the invention include providing an improved plate spacer for electrostatic precipitators which can be installed from either the top or bottom of the precipitator plates without requiring removal of any of the supports for the collector electrode plates or corona electrode wires, and which can be moved vertically to any desired position along the length of the plates without requiring a workman to physically enter the space between the plates for attaching the spacer to the plates. Another objective is to provide such a plate spacer which is slidably clamped to the projecting ribs which are formed by the interlocking connection of adjacent plate pairs, in which the spacer can be moved manually along the projecting ribs either from above or below the plates to the desired vertical position, and in which the plates will remain at the selected position without requiring any permanent or rigid attachment of the spacer to the precipitator plates as heretofore required.

A further objective of the invention is to provide such an improved plate spacer which has various frame configurations, the majority of said frames being formed of inexpensive cold-rolled carbon steel bars having hooks attached thereto at space locations, which hooks either connect directly to the projecting ribs of the joined plates for attaching the spacer therebetween or for connecting two frame members together in a clamping relationship with the plate ribs being clamped therebetween, for slidably mounting the frame members on the projecting ribs. Still another objective of the invention is to provide such an improved plate spacer which can be moved to different vertical positions along the plates at the time of installation and even after the spacer has been installed for a length of time to maintain parallel alignment of the horizontally spaced electrode plates throughout the vertical length thereof, and in which more than one spacer can be installed at any desired location along the length of the spaced plates should the plate warpage be serious enough to require a plurality of such spacers at various locations.

A further objective of the invention is to provide such an improved plate spacer which can be installed rapidly and conveniently between the electrode plates reducing the downtime of the precipitator, in which the spacers are intended primarily for use on existing precipitators to correct plate warpage, and in which such spacers solve problems existing in the art in an economical, efficient and satisfactory manner.

These objectives and advantages are obtained by the improved plate spacer of the invention which is intended for maintaining electrostatic precipitator plates in a horizontally spaced relationship, in which said plates are of the type having inwardly extending vertical ribs formed at the junction of two adjacent plates, and in which the general nature of said spacers may be stated as including rigid frame means for extending generally horizontally between a pair of spaced ribs formed on horizontal spaced precipitator plates; and guide means formed on the frame means for sliding frictional engagement with the spaced ribs for slidably vertically adjustably mounting said frame means on said ribs.

BRIEF DESCRIPTION OF THE DRAWINGS

Preferred embodiments of the invention, illustrative of the best mode in which applicant has contemplated applying the principles, are set forth in the following description and are shown in the drawings and are distinctly and particularly pointed out and set forth in the appended claims.

FIG. 7 is a fragmentary diagrammatic view of another modified plate spacer shown mounted on and extending between a pair of plate ribs;

FIG. 8 is a fragmentary sectional view taken on line 8—8, FIG. 7;

FIG. 9 is a fragmentary diagrammatic perspective view showing another modified form of the improved plate spacer mounted on and extending between a pair of plate ribs;

FIG. 10 is fragmentary sectional view taken on line 10—10, FIG. 9;

FIG. 11 is another fragmentary diagrammatic perspective view of another form of the improved plate spacer shown mounted on and extending between a pair of plate ribs;

FIG. 12 is a fragmentary sectional view taken on line 12—12, FIG. 11;

Similar numerals refer to similar parts throughout the drawings.

BEST MODE FOR CARRYING OUT THE INVENTION

Figure 1:
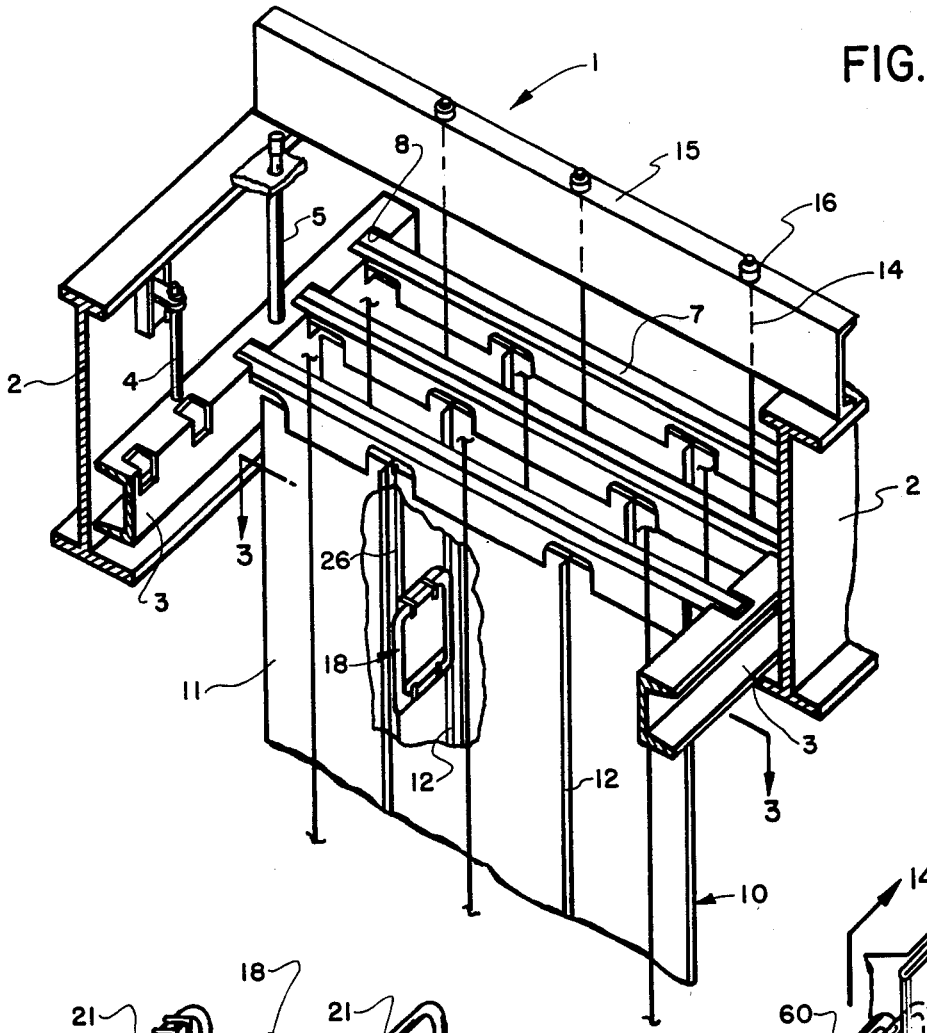
FIG. 1 is a fragmentary diagrammatic perspective view of an electrostatic precipitator with portions broken away and in section, showing one form of the improved spacer mounted on the precipitator plates.

A portion of a typical electrostatic precipitator unit of the type in which the improved spacer plates of the invention will be installed is shown in FIG. 1 and is indicated generally at 1. Only a part of one section of precipitator unit 1 is shown in FIG. 1. Unit 1 includes a pair of spaced main upper support beams 2 and a pair of spaced secondary plate support beams 3 suspended from main beams 2 by a plurality of support rods 4. A plurality of usual rappers 5 are mounted on main beam 2 and engage beams 3 for imparting periodic vibrations thereto, to discharge the collected dirt and dust particles from the collector plates, which particles fall into a lower collection area. A plurality of spaced horizontal plate support beams 7 extend between beams 3 and are received in end notches 8 formed in beams 3. A collector electrode plate indicated generally at 10, is suspended from each beam 7 and extend vertically downwardly therefrom. Each plate 10 is formed by a plurality of individual collector plate panels 11 which are joined together along their edges by interlocking flanges which form outwardly extending ribs 12.

A plurality of corona electrode wires 14 are suspended from a horizontal top beam 15 by insulators 16. A plurality of beams 15 are placed along and supported on main support beams 2 so that a plurality of wires 14 extend downwardly between plates 10 equidistance between adjacent plates.

Figure 2:
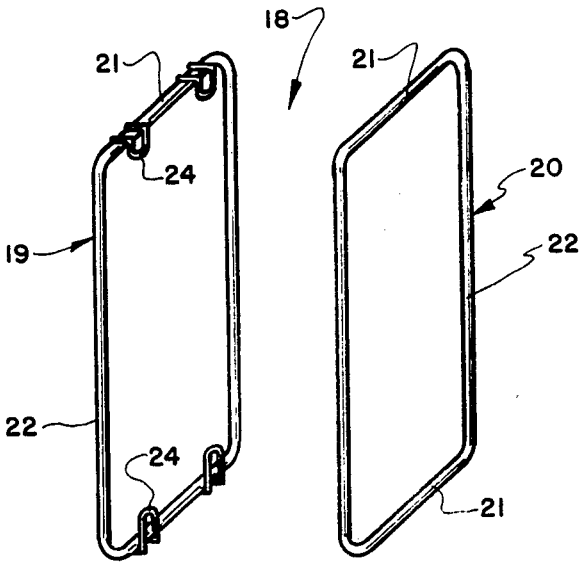
FIG. 2 is a perspective view of one form of the plate spacer in disassembled position.
Figure 3:
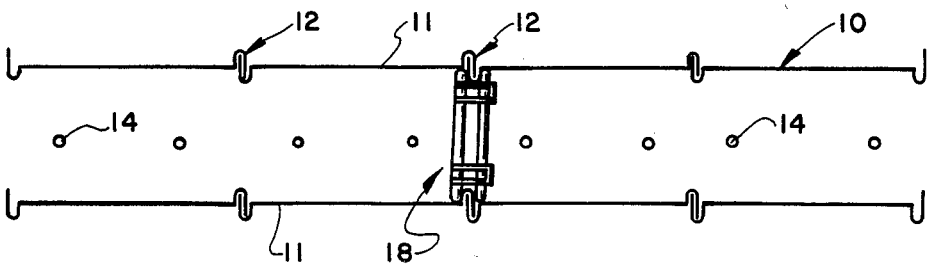
FIG. 3 is a diagrammatic top plan view of the plate spacer of FIGS. 1 and 2, shown in assembled position on the vertical ribs of spaced precipitator plates.
Figure 4:
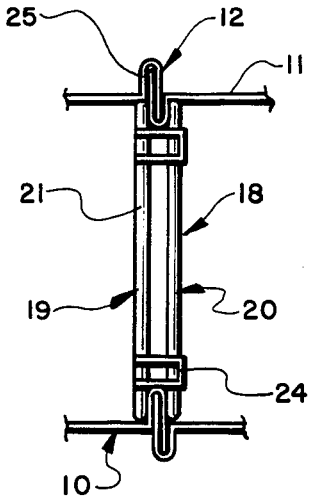
FIG. 4 is an enlarged top plan view of the plate spacer of FIGS. 2 and 3 shown in assembled position on the plate ribs.

One form of the improved plate spacer is indicated generally at 18, and is shown in FIG. 1 mounted on and extending between a pair of spaced plate ribs 12. Spacer 18 is shown in FIGS. 2, 3, and 4 and includes a pair of rectangular-shaped frames indicated generally at 19 and 20. Frames 19 and 20 are similar in size to each other, with each frame having a pair of spaced horizontal legs 21 and a pair of integrally connected vertically extending spaced legs 22. A pair of U-shaped hooks 24 are mounted on both upper and lower horizontal legs 21 of frame 19. Frames 19 and 20 preferably are formed of cold-rolled carbon steel bars circular in cross section, having a typical diameter of 5/16 inch. Hooks 26 may be formed of the same material as are frames 19 and 20 preferably of a 3/16 inch diameter bar stock. It is understood that the size and cross-sectional configuration of frames 19 and 20 and of hooks 24 may vary without affecting the concept of the invention.

Improved plate spacer 18 is shown in FIGS. 3 and 4 mounted on and extending between a pair of plate ribs 12. Spacer 18 preferably is installed by a workman from the top of the plates without requiring any movement or dismantling of top support beam 15 or plate support beams 7. The workman will first place either frame 19 or 20 between a spaced pair of plates 10 extending vertically along one side of a pair of spaced ribs 12 (FIG. 4). Vertical frame legs 22 are placed in abutment against the U-shaped end flanges 25 of one plate panel 11 which are interlocked with a similarly shaped flange 25 of the adjacent plate panel 11 (FIG. 4). The other frame member then is installed vertically along the other side of ribs 12, and the two frame members then are snapped together by inserting lower horizontal leg 21 of frame 20 behind hooks 24 of lower leg 21 of frame 19. The top horizontal leg 21 of frame 20 then is snapped behind the hooks 24 of top leg 21 of frame 19.

Frame 20 will have sufficient resiliency as well as the slight resiliency of hooks 24 enabling the two frame members to be snapped together, either manually or with a lever type pry bar (not shown) by the workman situated at the top of unit 1. The size of the spacing provided by hooks 24 is such so that frame members 19 and 20 are clamped tightly against opposite sides of ribs 12 as shown in FIG. 4.

After frames 19 and 20 are mounted on ribs 12 at the top of the spaced plates 10, the workman then will slide the assembled plate spacer 18 downwardly along ribs 12 to the desired vertical position in unit 1. This can be accomplished by either the use of a rod which shoves the spacer 18 downwardly along the ribs or by pulling it downwardly by a rope from the bottom of the unit. If the clamping engagement between vertical frame legs 22 against ribs 12 is not sufficient to provide the desired tension, the spacer may be lowered along the spaced ribs by a rope without effecting the maintenance of the horizontal spacing between the plates. (FIG. 1).

Preferably frame members 19 and 20 are clamped sufficiently tight against ribs 12 to be clampingly frictionally secured thereon. However, if the manufacturing tolerances or thickness of ribs 12 vary in a particular precipitator unit, plate spacer 18 still can be utilized by use of suspension wire rope or strap 26 without effecting the concept of the invention and the efficient results achieved. Horizontal legs 21 of frame 19 and 20 provide the desired horizontal spacing between plates 10, which spacing is unaffected by the clamping pressure exerted by vertical legs 22 against ribs 12. If desired, a plurality of spacers 18 may be spaced vertically along the same pair of horizontally spaced ribs 12 to achieve uniform spacing throughout the entire vertical length of plates 10. The number of spacers 18 installed will depend primarily upon the amount of warping of plates 10 and the vertical length thereof. A spacer 18 may be installed between each rib pair or at selected rib pairs depending upon the degree of warping of the particular unit.

Figure 5:
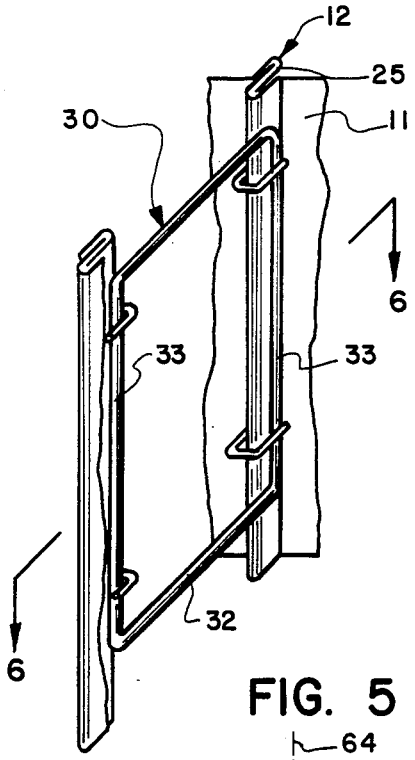
FIG. 5 is a fragmentary diagrammatic perspective view of a modified form of the improved plate spacer mounted on and extending between a pair of plate ribs.
Figure 6:
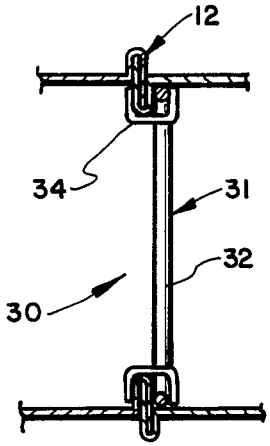
FIG. 6 is a fragmentary sectional view taken on line 6—6, FIG. 5.

A modified plate spacer is indicated generally at 30, and is shown in FIGS. 5 and 6. Plate spacer 30 is similar to spacer 18 except that a single rectangular-shaped frame member 31 is used instead of a pair of frame members 19 and 20 of spacer 18. Single frame 21 is formed by a pair of horizontal legs 32 and a pair of integrally joined vertical legs 33. Two pairs of U-shaped hooks 34 are mounted in spaced relationship on vertical legs 33. Hooks 34 are similar to hooks 24 of spacer 18 and clamp vertical legs 33 and the corner portion of horizontal legs 32 tightly against one side of spaced ribs 12 (FIG. 6) for mounting spacer 30 in position thereon.

Horizontal legs 32 provide the desired horizontal spacing between spaced plates 10. Again, should the rib thickness vary appreciably in a particular precipitator unit in which spacer 30 is installed, a suspension rope 26 (not shown) may be used in the same manner as shown in FIG. 1 with respect to spacer 18. Also, the vertical spacing of horizontal bars 32 by rigidly connected vertical bars 33 prevent twisting of the spacer between the spaced plates when mounted on ribs 12 and ensures that the correct horizontal spacing is maintained between the plates in a similar manner as do horizontal legs 21 of frame members 19 and 20 of spacer 18. This rigid rectangular configuration of the spacer frame prevents any twisting of the spacer between the spaced plates once the spacers are mounted therein.

A third modification of the improved plate spacer is indicated generally at 35, and is shown in FIGS. 7 and 8. Spacer 35 has a generally triangular configuration formed by a vertical leg 36 and a pair of inwardly converging legs 37 and 38. A pair of U-shaped hooks 39 are mounted on vertical leg 36 and are adapted to clampingly, frictionally engage plate rib 12 in the same manner as described above with respect to hooks 34 of plate spacer 30. Converging legs 37 and 38 are connected to an elongated channel 40. Channel 40 has a U-shaped configuration formed by pair of spaced legs 41 and a web wall 42. Channel 40 is slidably engaged with rib 12 with the majority of the positioning clamping force being provided by hooks 39. Channel 40 may have a predetermined width between legs 41 in order to provide some clamping engagement with engaged rib 12.

This triangular configuration of spacer 35 maintains the desired horizontal spacing between adjacent plates 10 and can be moved along the ribs in the same manner as described above with respect to spacers 18 and 30. Again the spacing of converging legs 37 and 38 by vertical leg 36 prevents any twisting or dislocation of spacer 35 once installed on and extending between spaced ribs 12.

A still further modification of the improved plate spacer is indicated generally at 45, and is shown in FIGS. 9 and 10. Spacer 45 includes an integral circular-shaped ring 46 formed of the same cold rolled steel bar material as are spacers 18, 30 and 35, and has two pairs of hooks 47 mounted at space locations on the ring with diametrically opposite arcuate portions of a bar forming upper and lower cross members. Hooks 47 preferably have a U-shaped configuration similar to that of hooks 34 and 39 and slidably frictionally engage ribs 12 as shown in FIG. 10 for positioning spacer ring 46 thereon. Again, the spaced location of the spacer ring mounting members or hooks 47 on ribs 12 prevent any twisting or dislocation of the spacer once installed between the spaced plates. The diameter of spacer ring 46 provides the desired horizontal spacing between the spaced collector plates 10.

Another modification of the improved plate spacer is indicated generally at 50, and is shown in FIGS. 11 and 12. Spacer 50 includes a single relatively flat bar 51 which is connected to a pair of end channels 52. Channels 52 have a U-shaped cross-sectional configuration formed by a pair of space legs 53 and a web wall 54. Bar 51 is connected to web wall 54 by welding or other similar attachment means. Bar 50 is installed on ribs 12 in the same manner as are the other plate spacers described above without requiring any temporary dismantling or removal of the precipitator supports as required in prior spacer bars.

One important feature of spacer 50 is that the vertical length of web walls 54 of channels 52 must be sufficient to provide more than a point contact with the inner edges of ribs 12 to prevent twisting and dislocation of the spacer bar from between the ribs. Web walls 54 preferably have a vertical length of at least several inches which will prevent any excess twisting after being installed between the ribs. Spacer 50 is installed by either pushing it with a rigid rod or the like from on top of the precipitator unit, or by lowering or pulling it with a rope into the desired position.

Figure 13:
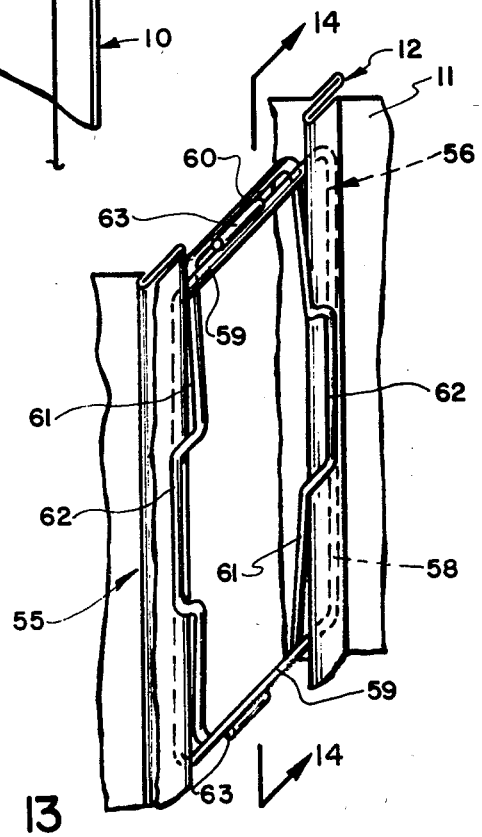
FIG. 13 is a fragmentary diagrammatic perspective view of another form of the improved plate spacer shown mounted on and extending between a pair of plate ribs.
Figure 14:
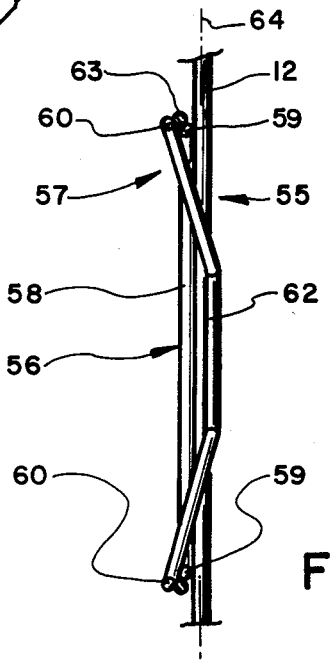
FIG. 14 is a fragmentary sectional view taken on line 14—14, FIG. 13.

A further modification of the improved plate spacer is indicated generally at 55, and is shown in FIGS. 13 and 14. Spacer 55 includes a pair of generally rectangular-shaped frames 56 and 57. Frame 56 is similar to frame 20 of spacer 18 and has an integral rectangular shape formed by a pair of vertical legs 58 and a pair of horizontal legs 59. Horizontal legs 59 provide for the desired horizontal spacing to be maintained between plates 10.

Frame 57 has a generally rectangular configuration formed by upper and lower horizontal legs 60 of a shorter length than horizontal legs 59 of frame 56. Frame legs 60 are connected by vertically extending legs 61 formed with integral outwardly projecting rectangular-shaped projections 62 (FIG. 13). A short section of round bar stock 63 is welded on each horizontal legs 60 and projects horizontally outwardly therefrom.

The use and operation of spacer 55 is somewhat similar to that of spacer 18. Rectangular frame 56 is installed on one side of ribs 12 with rectangular projections 62 of frame 57 being installed on the opposite side of the ribs 12 with the connecting vertical leg portions of frame 57 extending angularly between an imaginary plane 64 (FIG. 14) which extends vertically between the ribs 12. Ribs 12 are clamped between vertical legs 58 of frame 56 and projections 62 of frame 57. Bars 63 are snapped into engagement above and below horizontal legs 59 of frame 56 to lock frames 56 and 57 together. With this arrangement, a more positive frictional clamping engagement can be obtained by frame members 56 and 57 against ribs 12. The steel bars which form frame 57 have sufficient resiliency to enable the frames to be snapped together with projections 62 attempting to move to the left in FIG. 14 to securely clamp ribs 12 against the opposite portions of vertical legs 58 of frame 56.

Spacers 18, 30, 35, 45, 50 and 55 described above show various modifications which enable the desired results to be achieved, that is, a rigid member which ensures that a predetermined horizontal spacing be maintained between spaced adjacent collector plates without requiring any permanent attachment to the plates, and which can be installed from either above or below the precipitator unit without requiring a workman to physically enter the space between the plates. Furthermore, all of these spacer modifications provide a rigid frame which is resistive to horizontal compressive forces, thereby maintaining the plates in their spaced horizontal position and prevent plate warpage which can occur during the life of the electrode plates, and in which guide means such as the U-shaped hooks or channels, are mounted on the frame members for slidable frictional engagement with the spaced ribs to enable the frame to be vertically slidably adjusted along the spaced ribs to the desired vertical position between the collector plates.

Also, other forms of the improved plate spacer such as spacers 18 and 55, are formed of two separate members which are clamped together to provide a more positive clamping pressure against the plate ribs to ensure a positive clamping engagement therewith. The clamping pressure of spacer 55 is relatively unaffected by variances in rib thickness and manufacturing tolerances in the frame members in contrast to spacers 18, 30, 35, 45 and 50, which require closer tolerances to ensure the desired amount of sliding frictional clamping engagement between the mounting hooks and plate ribs.

The spaced attachment points of the various guide clamps that are mounted on the vertical legs of the clamping frames or at space locations on the ring-shaped frame of spacer 45, prevent undesirable twisting and disengagement of the spacer from between the ribs during and after installation thereon. Also, the fabrication of the various spacer frames of cold rolled steel bars provide a relatively inexpensive, yet sturdy and durable frame member. The diameters of these frame bars as well as of the bars which form the various guide hooks can vary depending upon the requirements of a particular precipitator unit.

A preferred size of spacer 18 is the horizontal legs 21 having a width of between eight and ten inches to match the desired horizontal spacing of the collector plates of a usual electrostatic precipitator, with vertical legs 22 having a length of between three and four feet. Also, the spacing between the slide mounting hooks of spacers 30, 35 and 40 is preferably two feet or greater to provide the desired rigidity to the frame to prevent any twisting thereof once installed between the ribs and being slid therealong.

Accordingly, the improved plate spacer is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved plate spacer for electrostatic precipitators is constructed and used, the characteristics of the spacer, and the advantageous, new and useful results obtained; the new and useful structures, devices, elements, arrangements, parts, and combinations, are set forth in the appended claims.

What is claimed is:

1. An improved spacer for maintaining a pair of adjacent electrostatic precipitator plates in a horizontally spaced relationship, wherein each of said plates is of the type having a generally planar vertically extending surface spaced horizontally from and extending parallel with the planar surface of the adjacent plate, and in which a vertically extending rib is formed on each of the plates and projects perpendicularly from the planar surface inwardly toward the rib on the adjacent plate, said spacer including:

(a) rigid frame means having upper and lower cross members joined by at least one generally vertical extending member, said frame means being adapted to extend horizontally between a pair of the spaced ribs formed on the precipitator plates for maintaining the plates in a predetermined horizontal spaced relationship; and (b) a pair of guide means formed on the frame means for slidably frictional clamping engagement with the spaced ribs for slidably vertically adjustably mounting said frame means on said ribs in a generally horizontally extending position between the horizontally spaced adjacent plates.

2. The spacer defined in claim 1 in which the guide means include U-shaped channels.

3. The spacer defined in claim 1 in which the frame means is a circular bar with diametrically opposite arcuate portions of said bar forming the upper and lower cross members; and in which the guide means is two pairs of U-shaped hooks attached to said bar.

4. The spacer defined in claim 1 in which the frame means is a generally triangular-shaped bar having a vertical leg and a pair of converging legs, with said vertical leg being the at least one generally vertical extending frame member of the frame means and said pair of converging legs being the upper and lower cross members of said frame means; and in which the guide means includes a pair of spaced U-shaped hooks attached to the vertical leg and a U-shaped channel mounted on the ends of the converging legs.

5. The spacer defined in claim 1 in which the frame means include a pair of rectangular-shaped frames, each frame having a pair of spaced horizontal legs connected to a pair of spaced vertical legs, with said vertical legs being the generally vertical extending frame member of the frame means and said horizontal legs being the upper and lower cross members of said frame means; in which clamps means is attached to the horizontal legs of one of the frames for engagement with the horizontal legs of the other frame for attaching together the two frames; and in which the vertical legs of the frames clamp the plate ribs therebetween to form the guide means when the two frames are attached together by the horizontal leg clamp means.

6. The spacer defined in claim 5 in which the clamp means include a pair of U-shaped hooks mounted in a spaced relationship on each of the horizontal legs of said one frame.

7. The spacer defined in claim 5 in which the frames are formed of metal bars circular in cross section.

8. The spacer defined in claim 5 in which the frames are generally equal in size to each other.

9. The spacer defined in claim 5 in which the vertical legs of one of the frame members have U-shaped formations which project outwardly from said legs; in which the horizontal legs when clamped together by the clamp means lie in abutting relationship with respect to each other on one side of an imaginary plane extending vertically between the spaced plate ribs on which the frames are adapted to be clamped; and in which the U-shaped formations are located on an opposite side of said imaginary plane from the horizontal legs and are adapted to be clamped against the plate ribs to slidably mount the frames on said ribs.

10. The spacer defined in claim 9 in which the clamp means is a section of round bar stock attached to each of the horizontal legs; and in which the frame having the U-shaped formations has sufficient resiliency to extend between opposite sides of the imaginary plane and clamp against the plate ribs to provide the guide means for slidably adjustably mounting the frame means on said ribs when the frames are clamped together by the bar stock clamp means.

11. The spacer defined in claim 1 in which the frame means includes a rectangular-shaped frame formed of steel bar having a pair of spaced horizontal legs forming the upper and lower cross members of said frame means and a pair of connected spaced vertical legs forming the at least one generally vertical extending frame member; and in which the guide means includes two pairs of U-shaped hooks, each pair being mounted on a respective vertical frame leg, said hooks being adapted to slidably frictionally engage the spaced ribs to mount the frame on said ribs with the horizontal legs extending horizontally between the spaced plates to maintain said plates in their predetermined spaced relationship.

12. An electrostatic precipitator including a plurality of collector electrode plates; means for suspending said plates in a horizontally spaced, vertically hanging position; said spaced plates having vertically extending ribs formed thereon and projecting inwardly toward the ribs of the horizontally spaced adjacent plate; frame means for extending horizontally between the plate ribs for maintaining the horizontal spacing between the suspended plates, said frame means having rigid upper and lower cross members joined by at least one generally vertical extending connecting member; and a pair of guide means formed on the frame means, said guide means slidably frictionally connecting the frame means to the ribs for manually moving the frame means along the ribs to a predetermined position between the spaced plates.

13. The precipitator defined in claim 12 in which the ribs are formed by interlocked end flanges formed on the edges of abutting electrode plates.

14. The precipitator defined in claim 12 in which the frame means include at least one frame member formed of a steel bar having the upper and lower cross members and the at least one vertical extending member of the frame means; in which the guide means include U-shaped hook members formed on the frame member; and in which the U-shaped hook members are slidably clampingly engaged with the ribs to adjustably mount the frame member thereon.

15. The precipitator defined in claim 12 in which the frame means includes two frame members each having a generally rectangular configuration having the upper and the at least one lower cross members and vertical extending member of the frame means; and in which clamp members are formed on the upper and lower cross members of at least one of the frame members for clamping said frame members together whereby portions of the frame members form the guide means to provide the pressure engagement with the ribs and to clamp the spaced ribs between the frame members to slidably mount the frame means on said ribs.

16. The precipitator defined in claim 15 in which each of the frame members includes a pair of spaced horizontal legs which form the upper and lower cross members and a pair of spaced vertical legs which form the at least one vertical extending member of the frame means; in which the vertical legs are joined to said horizontal legs; and in which the clamp members are formed on the horizontal legs of at least one of the frame members and are clampingly engaged with the horizontal legs of the other frame members.

17. The precipitator defined in claim 16 in which outwardly extending projections are formed on the vertical legs of one of the frame members; and in which the ribs are clamped between the vertical leg projections of said one frame member and the vertical legs of the other frame member to form the guide means to provide the pressure engagement with the ribs.

18. The precipitator defined in claim 17 in which the horizontal legs clamped together by the clamp members are located on one side of an imaginary plane extending vertically between the spaced ribs; and in which the vertical leg projections are located on an opposite side of the imaginary plane from the horizontal legs.

* * * * *